United States Patent [19]

Moore et al.

[11] 4,384,528

[45] May 24, 1983

[54] DUPLEX ROUND

[75] Inventors: Kenneth L. Moore, Silver Springs, Md.; William L. Black, China Lake, Calif.

[73] Assignee: The United States of America as represented by the Secretary of the Navy, Washington, D.C.

[21] Appl. No.: 137,202

[22] Filed: Apr. 7, 1980

[51] Int. Cl.[3] ..... F42B 11/00

[52] U.S. Cl. ..... 102/503; 102/364; 102/519

[58] Field of Search ..... 102/364, 365, 374, 430, 102/439, 503, 517–519, 532, 520–523

[56] References Cited

U.S. PATENT DOCUMENTS

| | | | |
|---|---|---|---|
| 1,292,388 | 1/1919 | Bowers | 102/503 |
| 1,327,531 | 1/1920 | Durham | 102/503 |
| 3,148,472 | 9/1964 | Hegge et al. . | |
| 3,372,370 | 3/1968 | Cyr | 367/167 |
| 3,433,157 | 3/1969 | Joch | 102/503 |
| 3,452,677 | 7/1969 | Abela . | |
| 3,613,584 | 10/1971 | Hendricks . | |
| 3,628,457 | 1/1971 | Magnusson | 102/374 |
| 3,698,320 | 10/1972 | Cochran et al. | 102/374 |
| 3,726,231 | 4/1973 | Kelly et al. . | |
| 3,759,184 | 9/1973 | Blajda et al. | 102/532 |

FOREIGN PATENT DOCUMENTS

| | | | |
|---|---|---|---|
| 2420116 | 10/1979 | France | 102/520 |

*Primary Examiner*—Harold J. Tudor

*Attorney, Agent, or Firm*—R. F. Beers; W. Thom Skeer

[57] ABSTRACT

A duplex projectile to be fired from a gun bore is made up of a tubular projectile and a conical shaped projectile fastened within the tubular projectile by means which are capable of withstanding acceleration forces on the round while the round is within the bore after being fired but which release the conical projectile from the tubular projectile once the two exit from the bore.

10 Claims, 3 Drawing Figures

DUPLEX ROUND

BACKGROUND OF THE INVENTION

1. Field of the Invention

This invention relates to ammunition. More specifically, this invention relates to a duplex round of ammunition comprising a tubular projectile which spins when fired from a gun and a conical projectile which is fastened within the tubular projectile when the round is fired but which separates from the tubular projectile when the duplex projectile leaves the gun barrel.

2. Description of the Prior Art

Spinning tubular projectiles present an attractive alternative to solid projectiles because they have better ballistic characteristics. The drag forces on spinning tubular projectiles are smaller than those on conventional solid projectiles.

To fire a spinning tubular projectile from a gun, the projectile must be provided with a closure which gives the expanding powder gases something to push against.

Once the tubular projectile has left the gun barrel, the closure must be discarded in order that the tubular shape (which is the reason for the advantage of a tubular projectile over a conventional solid projectile) may be taken advantage of. Discarded closures or sabots present a problem when tubular projectiles are fired from aircraft guns. A high speed jet aircraft may overtake them and ingest them into the jet intake causing damage to the aircraft engine. Accordingly, it would be advantageous to provide a high pressure obturator which could not be overtaken.

SUMMARY OF THE INVENTION

According to this invention, a duplex round of ammunition comprising a tubular projectile and a conical inner projectile is provided. The conical projectile is affixed to the inner surface of the tubular projectile by means which are capable of withstanding acceleration forces within the gun bore while the round is in the bore but which release upon exit of the round from the bore. This permits the conical projectile to act as a high pressure obturator while the round is under pressure from gun propellant gases in the barrel and as a subcaliber projectile once it and the tubular projectile separate.

DESCRIPTION OF THE PREFERRED EMBODIMENTS

Figure 1:
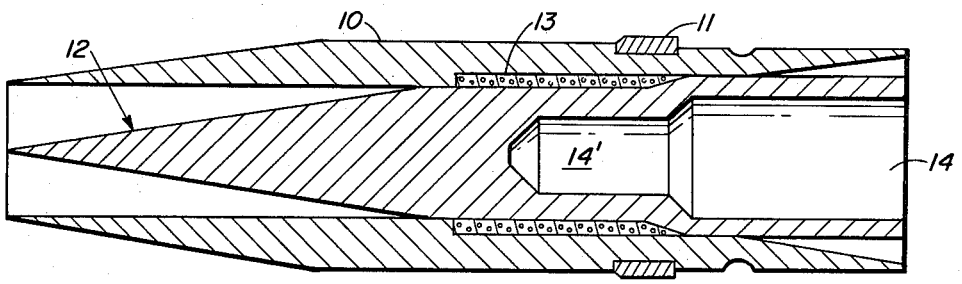
FIG. 1 is a cross-sectional view of one embodiment of this invention.

An understanding of this invention may be had from the drawing.

FIG. 1 depicts an outer tubular projectile 10 having rotation bands 11 adapted to interact with rifling in a gun barrel and cause the projectile to spin. Affixed within the tubular projectile 10 is a conical shaped projectile 12. The conical projectile is affixed by affixing means 13.

Affixing means 13 must be a material which will hold the two projectiles together while they are under pressure in the gun bore but which will allow the two projectiles to separate once they have emerged from the gun barrel. An example of a suitable affixing means is an elastic sealant such as silicone rubber which may have a compressible media such as microbaloons suspended within it. In lieu of microbaloons, air may be entrained into silicone rubber by whipping and will act as a compressible media.

This conical projectile has a rear cavity or hollowed out portion 14 in its base and a forward cavity 14' in its midsection. This renders the projectile aerodynamically stable by causing its center of gravity to be forward of the center of pressure at launch.

When the duplex projectile of this invention is fired from a gun, positive force is applied to its rear portions by expanding gun gases. While the duplex projectile is in the bore the above-described affixing means 13 will become compressed. After the duplex projectile leaves the bore, the affixing means will rapidly decompress and force the subcaliber (conical) projectile from the tubular projectile. After separation, the tubular projectile is affected less by aerodynamic drag and thus maintains its velocity more efficiently.

The conical projectile follows in the wake of the tubular projectile at least for an appreciable amount of time. The conical projectile, because of its design and weight, however, travels at a rate of speed which is much too great to permit it to be overtaken even by the fastest jet aircraft.

If the tubular projectile impacts with a target within a reasonably short period of time after exit from the gun bore, the conical projectile will still be relatively close behind. In such a situation, a dual effect is obtained. The tubular projectile will penetrate the target and the conical projectile will enter the target through the penetration. For this reason, a second embodiment of the invention entails filling a portion of the conical projectile with an explosive charge and a fuse which will detonate the charge once the projectile has entered the target.

Figure 2:
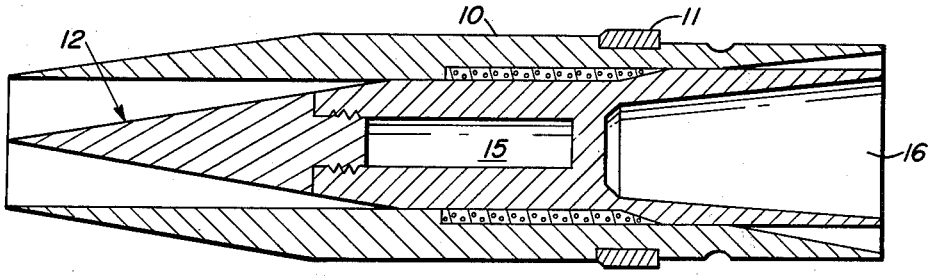
FIG. 2 is a cross-sectioned view of a second embodiment of this invention.

FIG. 2 of the drawing shows a tubular projectile 10 and conical projectile 11 adapted for this embodiment. In this figure, the conical projectile has two cavities, 15 and 16 in lieu of cavities 14 and 14' of FIG. 1. This permits an explosive charge to be loaded into cavity 15 and a solid in-bore propellant grain to be loaded into cavity 16. Upon firing, the propellant grain is ignited. It provides a traveling charge which is consumed before muzzle exit. The explosive charge is utilized to provide additional effectiveness once the conical projectile has entered a target as discussed above.

In practicing this invention, it is preferred that the materials from which the two projectiles are fabricated be a high density material such as steel, tungsten, refractory carbide, refractory boride, depleted uranium or the like. The two projectiles may be of the same or different materials.

It is important that the center of gravity of the conical shaped projectile be forward of the center of pressure at launch. Otherwise the projectile will not fly true.

Figure 3:
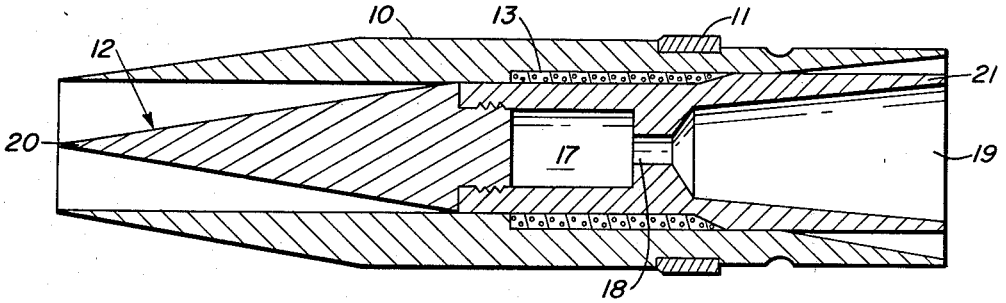
FIG. 3 is a cross-sectional view of a tubular projectile and conical projectile suitable for use in practicing third, fourth and fifth embodiments of this invention.

A device adapted for a third embodiment is shown in FIG. 3. In this embodiment a cavity 17 in the tubular projectile is filled with an incendiary material instead of the explosive charge of the second embodiment and, a flash hole 18 is provided between cavity 17 and a second cavity 19. This permits the incendiary material to be ignited by gun gases.

In yet a fourth embodiment, cavity 19 of FIG. 3 is loaded with gun powder. This powder provides a greater loading density than currently existing ammunition.

In a fifth embodiment, cavities 17 and 19 of FIG. 3 are both filled with gun powder, depleted uranium is used to form the nose 20 of the conical projectile and a lightweight pyrophoric material such a titanium or aluminum is used to form the rear portion of aft end 21 tubular projectile. In this embodiment, the entire conical projectile is pyrophoric and is consumed on impact with a target.

When a duplex round according to this invention is used, it is fired from a conventional ammunition casing containing conventional powder. Since cartridge casings and gun powder are so well known and since they form no part of this invention, they are not depicted in the drawing.

What is claimed is:

1. A duplex round comprising:

a tubular projectile of a dense material adapted for target penetration and having a central axial bore;

a sub-diameter projectile held within said axial bore throughout its length and configured to be an obturator for said tubular projectile; and bonding material between said sub-diameter projectile and said tubular projectile and adapted to form a seal therebetween which is compressable during the interior ballistic phase of projectile flight and releases during aerial flight to permit separation of the two projectiles.

2. A duplex round according to claim 1 wherein said sub-diameter projectile has a hollowed out portion in its base.

3. A duplex round according to claim 1, wherein said sub-diameter projectile has a first hollowed out portion in its base and a second hollowed out portion inside of it forward of said first hollowed out portion, said first hollowed out portion adapted to hold a propellant grain and said second hollowed out portion adapted to hold an explosive charge.

4. A duplex round according to claim 1 wherein said sub-diameter projectile has a first hollowed out portion in its base, a second hollowed out portion inside of it forward of said first hollowed out portion and an opening connecting said first hollowed out portion with said second hollowed out portion, said second hollowed out portion being adapted to hold incendiary material.

5. A duplex round according to claim 4 wherein said first hollowed out portion is adapted to hold gun powder.

6. A duplex round according to claim 1 wherein said bonding material is silicone rubber impregnated with microbaloons.

7. A duplex round according to claim 1 wherein said bonding material is silicone rubber with air entrained in it.

8. A duplex round comprising:

a tubular projectile having a central axial bore;

a sub-diameter projectile having a depleted uranium nose and a light pyropheric base end with a first hollowed-out portion in the base end and second, inside, hollowed-out portion adapted to hold incendiary material forward from said first hollowed-out portion and an opening connecting said first and second hollowed-out portions; and bonding material between said sub-diameter projectile and said tubular projectile adapted to form a seal therebetween which is compressable during the interior ballistic phase of projectile flight but releases during aerial flight to permit separation of the two projectiles.

9. A duplex round according to claim 8 wherein said pyrophoric material is aluminum.

10. A duplex round according to claim 8 wherein said pyrophoric material is titanium.

* * * * *